US009541295B2

(12) United States Patent
Adelmann et al.

(10) Patent No.: US 9,541,295 B2
(45) **Date of Patent: *Jan. 10, 2017**

(54) OVEN APPLIANCE

(71) Applicant: General Electric Company, Schenectady, NY (US)

(72) Inventors: Christopher James Adelmann, Louisville, KY (US); Cecil Clay Clements, Louisville, KY (US); Stephen Bernard Froelicher, Shepherdsville, KY (US)

(73) Assignee: Haier U.S. Appliance Solutions, Inc., Wilmington, DE (US)

( * ) Notice: Subject to any disclaimer, the term of this patent is extended or adjusted under 35 U.S.C. 154(b) by 313 days.

This patent is subject to a terminal disclaimer.

(21) Appl. No.: 14/297,194

(22) Filed: Jun. 5, 2014

(65) Prior Publication Data

US 2015/0354828 A1 Dec. 10, 2015

(51) Int. Cl.
*F24C 15/02* (2006.01)
*F24C 15/16* (2006.01)

(52) U.S. Cl.
CPC ..... *F24C 15/162* (2013.01); *F24C 15/02* (2013.01); *F24C 15/023* (2013.01); *F24C 15/028* (2013.01); *F24C 15/16* (2013.01)

(58) Field of Classification Search
CPC ..... F24C 15/162; F24C 15/023; F24C 15/02; F24C 15/028; F24C 15/16
See application file for complete search history.

(56) References Cited

U.S. PATENT DOCUMENTS

| | | | | |
|---|---|---|---|---|
| 1,960,365 | A * | 5/1934 | Barker | F24C 15/16 126/339 |
| 1,970,343 | A | 8/1934 | Sherman | |
| 2,296,950 | A | 9/1942 | Roedl | |
| 2,539,151 | A | 1/1951 | Mills | |
| 2,649,085 | A | 8/1953 | Hurt | |
| 3,830,220 | A | 8/1974 | Demetreon | |
| 4,149,518 | A | 4/1979 | Schmidt et al. | |
| 2004/0112371 | A1 | 6/2004 | Le et al. | |
| 2010/0218755 | A1 | 9/2010 | Stewart et al. | |
| 2014/0137856 | A1 | 5/2014 | Elkasevic | |
| 2015/0354828 | A1 | 12/2015 | Adelmann et al. | |
| 2015/0354829 | A1 | 12/2015 | Adelmann et al. | |

FOREIGN PATENT DOCUMENTS

| | | | |
|---|---|---|---|
| JP | 2005192870 | A | 7/2005 |
| JP | 4818377 | B2 | 11/2011 |

* cited by examiner

*Primary Examiner* — Alfred Basichas
(74) *Attorney, Agent, or Firm* — Dority & Manning, P.A.

(57) ABSTRACT

An oven appliance includes features for permitting movement of a door of the oven appliance relative to a cabinet of the oven appliance. The oven appliance also includes a hinge assembly that couples the door to at least one of the first and second slide assemblies such that the door is pivotable. The hinge assembly includes a bearing disposed within one of a series of detents. A related double oven range appliance is also provided.

20 Claims, 13 Drawing Sheets

OVEN APPLIANCE

FIELD OF THE INVENTION

The present subject matter relates generally to oven appliances, such as double oven range appliances.

BACKGROUND OF THE INVENTION

Double oven range appliances generally include upper and lower cooking chambers. A user of the double oven range appliances may conveniently utilize either or both of the upper and lower cooking chambers to cook food items. In certain double oven range appliance, the upper cooking chamber is smaller than the lower cooking chamber. Thus, the user may utilize the upper cooking chamber to cook smaller food items and the lower cooking chamber to cook larger food items.

Double oven range appliances also generally include two doors, one for the upper cooking chamber and another for the lower cooking chamber. The doors are generally rotatably mounted to a cabinet of the appliance with hinges. Thus, the user of the double oven range appliance may rotate the doors open on the hinges in order to access the upper and lower cooking chambers.

Hinges have certain drawbacks that may be inconvenient or undesirable to users. For example, removing food items from the upper cooking chamber can be difficult or awkward. In particular, the upper cooking chamber may be relatively small compared to the lower cooking chamber, and reaching into the upper cooking chamber to grasp and handle cookware therein can be difficult or awkward. In addition, monitoring the cooking of food items within the upper cooking chamber can be difficult due to poor visibility of the food items within the upper cooking chamber even when the door to the upper cooking chamber is open.

Accordingly, an oven appliance with features for facilitating access to food items within a cooking chamber of the oven appliance would be useful. In addition, an oven appliance with features for facilitating monitoring of food items within a cooking chamber of the oven appliance would be useful.

BRIEF DESCRIPTION OF THE INVENTION

The present subject matter provides an oven appliance. The oven appliance includes features for permitting movement of a door of the oven appliance relative to a cabinet of the oven appliance. The oven appliance also includes a hinge assembly that couples the door to at least one of the first and second slide assemblies such that the door is pivotable. The hinge assembly includes a bearing disposed within one of a series of detents. A related double oven range appliance is also provided. Additional aspects and advantages of the invention will be set forth in part in the following description, or may be apparent from the description, or may be learned through practice of the invention.

In a first exemplary embodiment, an oven appliance is provided. The oven appliance defines a lateral direction and a transverse direction. The lateral and transverse directions are perpendicular to each other. The oven appliance includes a cabinet that defines a cooking chamber and an opening for accessing the cooking chamber of the cabinet. The cabinet extends between a first side portion and a second side portion along the lateral direction. A heating element is positioned at the cooking chamber of the cabinet. A first slide assembly is mounted to the cabinet at the first side portion of the cabinet. A second slide assembly is mounted to the cabinet at the second side portion of the cabinet. A door is positioned adjacent the opening of the cabinet. The first and second slide assemblies couple the door to the cabinet such that the door is movable along the transverse direction relative to the cabinet. A hinge assembly couples the door to at least one of the first and second slide assemblies such that the door is pivotable between a vertical position and a peak position. The hinge assembly includes a bracket mounted to the door. A hinge arm is rotatably mounted to the bracket. The hinge arm defines a series of detents. A bearing is disposed within one of the series of detents and extends between the bracket and the hinge arm.

In a second exemplary embodiment, a double oven range appliance is provided. The double oven range appliance defines a vertical direction, a lateral direction and a transverse direction. The vertical, lateral and transverse directions being mutually perpendicular. The double oven range appliance includes a cabinet that extends between a first side portion and a second side portion along the lateral direction. The cabinet also extends between a top portion and a bottom portion along the vertical direction. The cabinet defines an upper cooking chamber positioned adjacent the top portion of the cabinet and a lower cooking chamber positioned adjacent the lower portion of the cabinet. The cabinet also defines an opening for accessing the upper cooking chamber of the cabinet. A heating element is positioned at the upper cooking chamber of the cabinet. A pair of slide assemblies is mounted to the cabinet at the upper cooking chamber. Each slide assembly of the pair of slide assemblies is positioned at a respective one of the first and second side portions of the cabinet. A door is positioned adjacent the opening of the cabinet. The pair of slide assemblies couple the door to the cabinet such that the door is movable along the transverse direction relative to the cabinet. A hinge assembly couples the door to one of the pair of slide assemblies such that the door is pivotable between the vertical position and the peak position. The hinge assembly includes a bracket mounted to the door. A hinge arm is rotatably mounted to the bracket. Hinge arm defines a series of detents. A bearing is disposed within one of the series of detents and extends between the bracket and the hinge arm.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
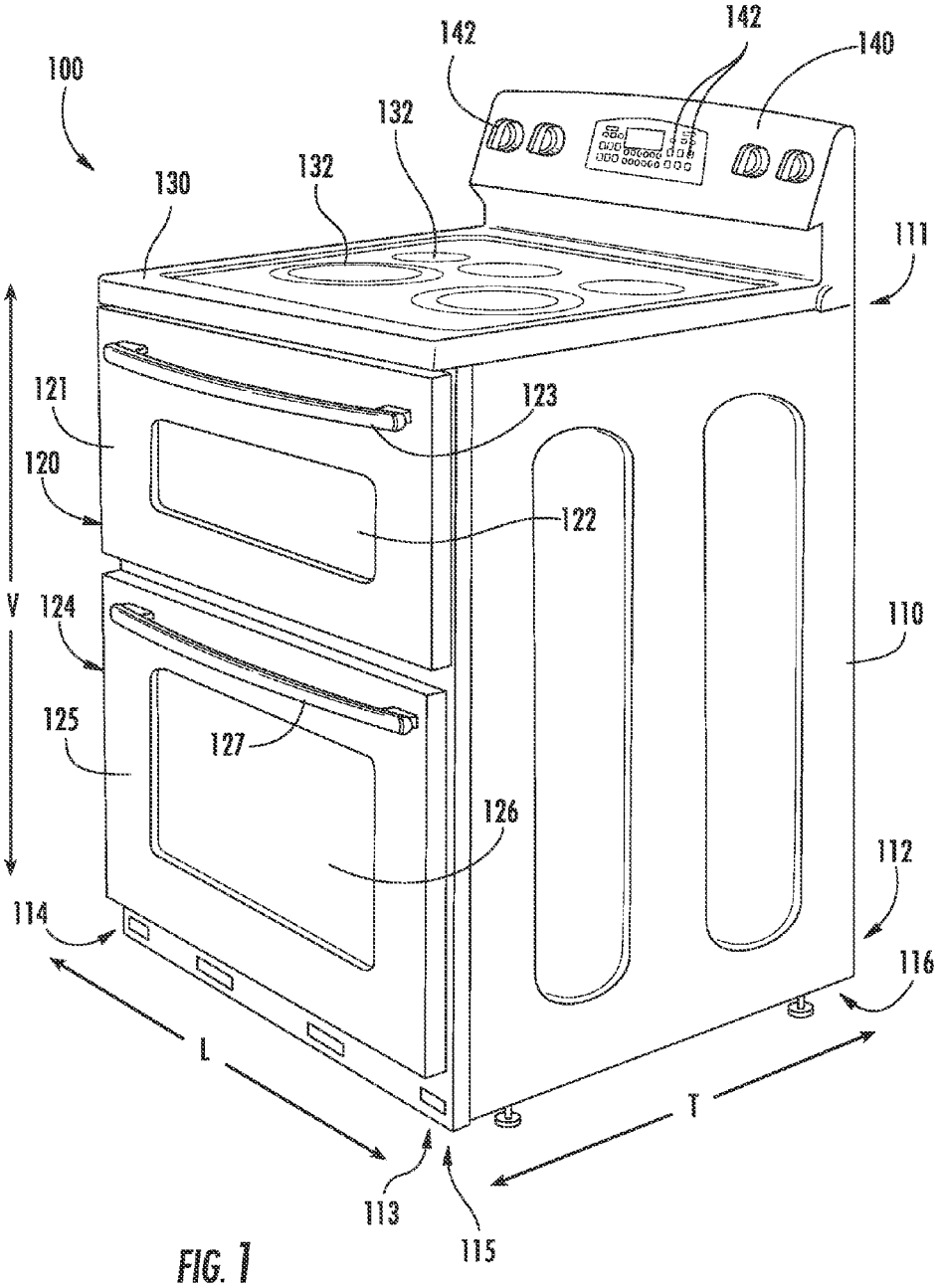
FIGS. 1, 2, 3 and 4 provide perspective views of an oven range appliance according to an exemplary embodiment of the present subject matter with a door of the exemplary oven appliance shown in various positions and orientations.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIGS. 1, 2, 3 and 4 provide perspective views of an oven range appliance 100 according to an exemplary embodiment of the present subject matter. In FIGS. 1, 2, 3 and 4, an upper door 121 of range appliance 100 is shown various positions and orientations, as discussed in greater detail below. As may be seen in FIGS. 1, 2, 3 and 4, range appliance 100 defines a vertical direction V, a lateral direction L and a transverse direction T. The vertical, lateral and transverse directions are mutually perpendicular and form an orthogonal direction system.

Range appliance 100 includes an insulated cabinet 110. Cabinet 110 extends between a top portion 111 and a bottom portion 112, e.g., along the vertical direction V. Thus, top and bottom portions 111, 112 of cabinet 110 are spaced apart from each other, e.g., along the vertical direction V. Cabinet 110 also extends between a first side portion 113 and a second side portion 114, e.g., along the lateral direction L. Thus, first and second side portions 113, 114 of cabinet 110 are spaced apart from each other, e.g., along the lateral direction L. Cabinet 110 further extends between a front portion 115 and a back portion 116, e.g., along the transverse direction T. Thus, front and back portions 115, 116 of cabinet 110 are spaced apart from each other, e.g., along the transverse direction T.

Range appliance 100 includes a cooktop 130 positioned at or adjacent top portion 111 of cabinet 110. Cooktop 130 includes various heating elements 132, such as gas burners, electric resistance elements, induction elements, etc., that are configured for heating cookware positioned thereon. As may be seen in FIG. 1, cabinet 110 also defines an upper cooking chamber 120 and a lower cooking chamber 124. Thus, range appliance 100 is generally referred to as a double oven range appliance. As will be understood by those skilled in the art, range appliance 100 is provided by way of example only, and the present subject matter may be used in any suitable oven appliance, e.g., a single oven range appliance, a single wall oven appliance, a double wall oven appliance, etc.

Upper cooking chamber 120 is positioned at or adjacent top portion 111 of cabinet 110. Conversely, lower cooking chamber 124 is positioned at or adjacent bottom portion 112 of cabinet 110. Thus, upper and lower cooking chambers 120, 124 are spaced apart from each other along the vertical direction V. Upper and lower cooking chambers 120, 124 can have any suitable size relative to each other. For example, as shown in FIG. 1, upper cooking chamber 120 may be smaller than lower cooking chamber 124.

Upper and lower cooking chambers 120, 124 are configured for receipt of one or more food items to be cooked. Range appliance 100 includes an upper door 121 and a lower door 125 that are attached or coupled to cabinet 110, e.g., with slide assemblies and hinges as discussed in greater detail below, in order to permit selective access to upper cooking chamber 120 and lower cooking chamber 124, respectively. Handles 123, 127 are mounted to upper and lower doors 121, 125 to assist a user with opening and closing doors 121, 125 in order to access cooking chambers 120, 124. As an example, a user can pull on handle 123 mounted to upper door 121 to open or close upper door 121 and access upper cooking chamber 120. Glass window panes 122, 126 provide for viewing the contents of upper and lower cooking chambers 120, 124 when doors 121, 125 are closed and also assist with insulating upper and lower cooking chambers 120, 124. Heating elements such as electric resistance heating elements, gas burners, microwave elements, etc., are positioned within upper and lower cooking chambers 120, 124 of cabinet 110 for heating upper and lower cooking chambers 120, 124. In particular, heating element 160 (FIG. 6) is positioned within upper cooking chamber 120 and is configured for selectively heating upper cooking chamber 120.

A control panel 140 of range appliance 100 is positioned at top portion 111 and back portion 116 of cabinet 110. Control panel 140 includes user inputs 142. Control panel 140 provides selections for user manipulation of the operation of range appliance 100. For example, a user can touch control panel 140 to trigger one of user inputs 142. In response to user manipulation of user inputs 142, various components of the range appliance 100, such as heating element 160, can be operated.

Figure 2:
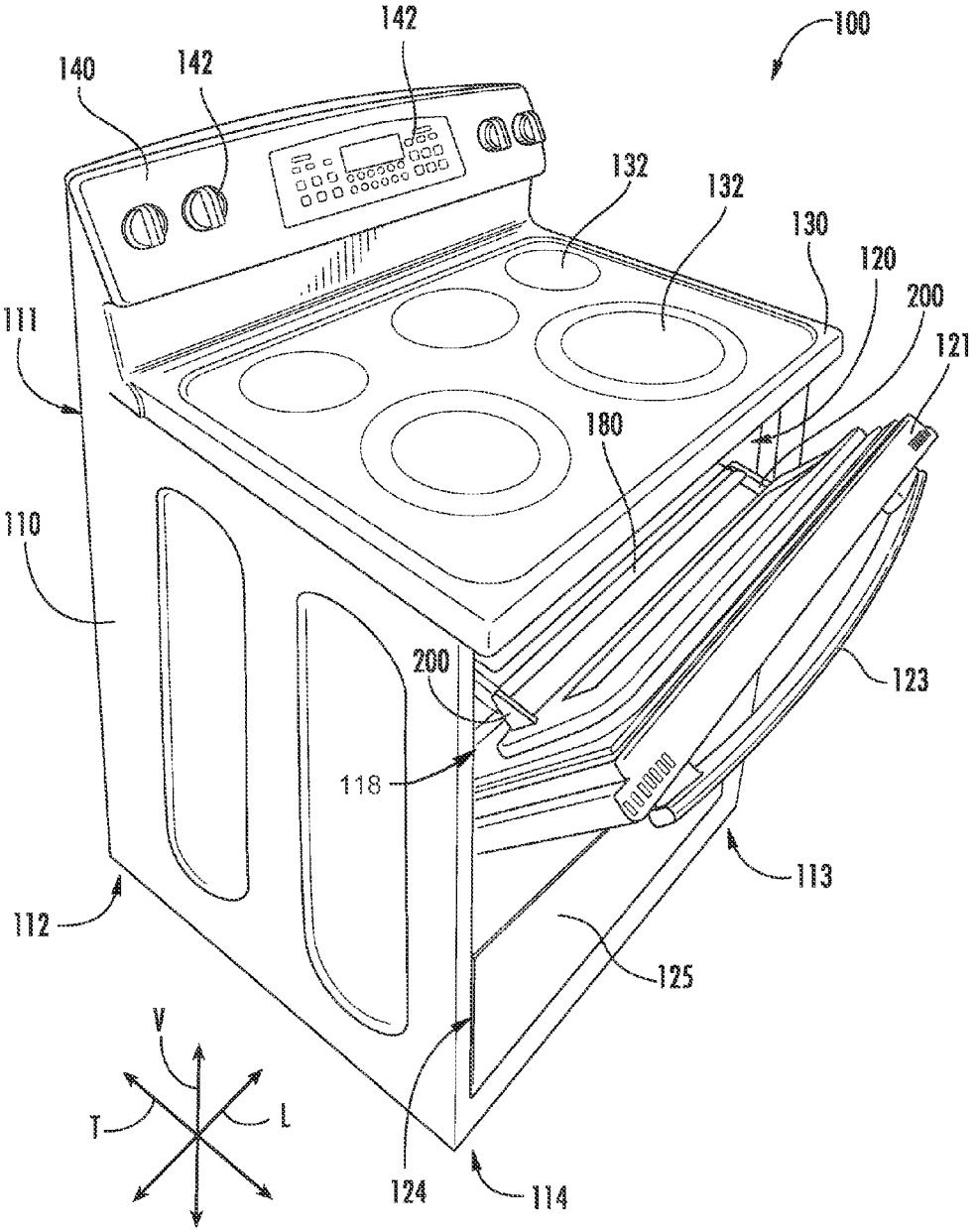
Figure 3:
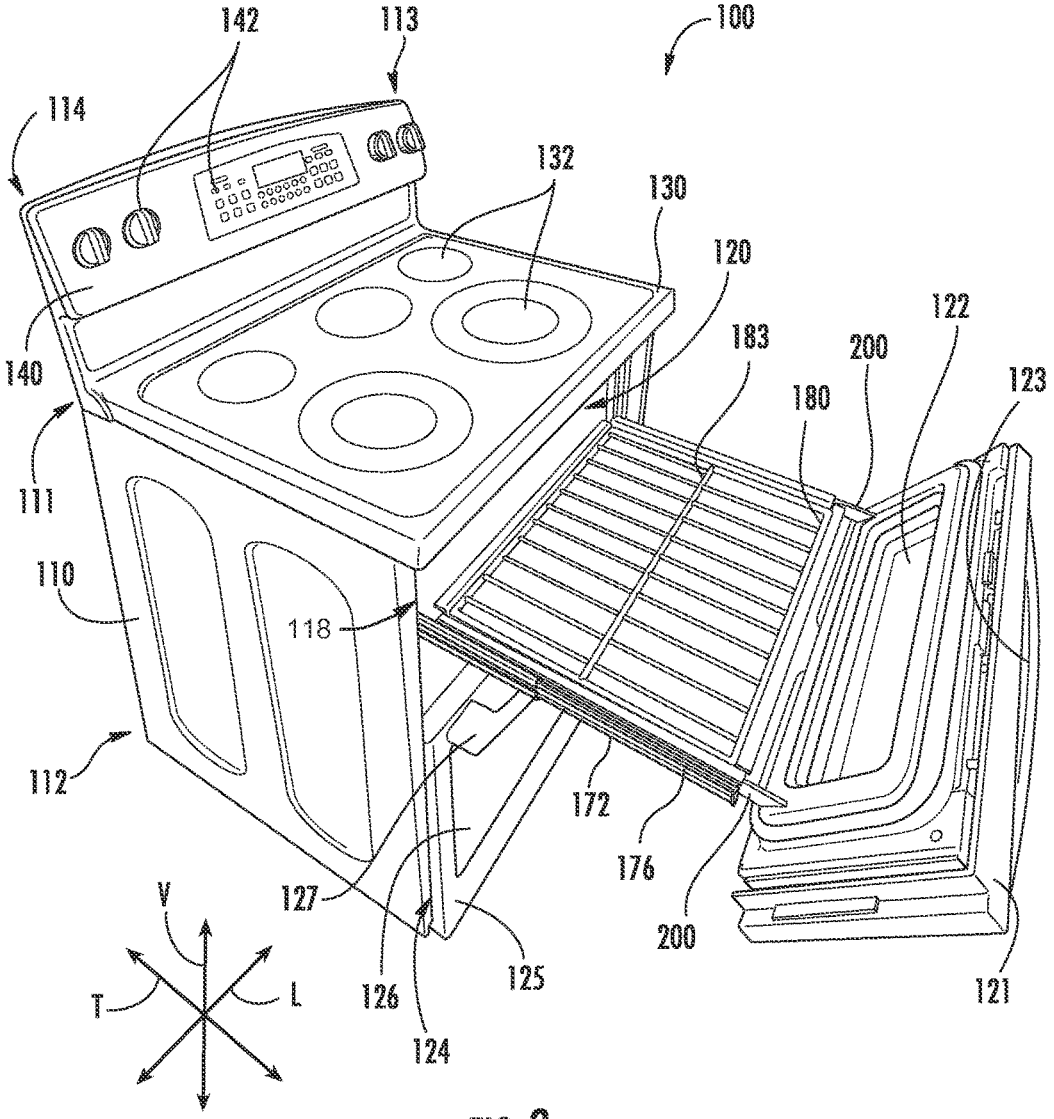

As may be seen in FIGS. 1, 2, 3 and 4, upper door 121 may be positioned and oriented in a variety of configurations and positions. For example, door 121 is shown in a closed position and a vertical configuration in FIG. 1. As another example, upper door 121 is shown in the closed position and a peak configuration in FIG. 2. In FIG. 3, upper door 121 is shown in an open position and the peak configuration. Conversely, upper door 121 is shown in the open position and the vertical configuration in FIG. 4. A user of range appliance 100 may adjust upper door 121 between the various positions and configurations shown in FIGS. 1, 2, 3 and 4. For example, the user may grasp handle 123 of upper door 121 and move upper door 121, e.g., along the transverse direction T, between the closed and open positions and/or pivot upper door 121, e.g., on an axis that is parallel to the lateral direction L, between the vertical and peak configurations.

To permit movement of upper door 121, e.g., along the transverse direction T, range appliance 100 includes a pair of slide assemblies or slide rails 172 that slidably couple upper door 121 to cabinet 110. Slide assemblies 172 are mounted to cabinet 110 at or adjacent upper cooking chamber 120. Each slide assembly of slide assemblies 172 are positioned at a respective one of the first and second side portions 113, 114 of cabinet 110. In particular, slide assemblies 172 include a first slide assembly or set of slide rails 174 and a second slide assembly or set of slide rails 176. First slide assembly 174 is mounted to cabinet 110 at or adjacent first side portion 113 of cabinet 110, and second slide assembly 176 is mounted to cabinet 110 at or adjacent second side portion 114 of cabinet 110.

Slide assemblies 172 may be mounted to any suitable component of cabinet 110 and positioned at any suitable location on cabinet 110. For example, slide assemblies 172 may be mounted to cabinet 110 within upper cooking chamber 120. Thus, slide assemblies 172 may be positioned within upper cooking chamber 120, e.g., when upper door 121 is in the closed position. As another example, slide assemblies 172 may be mounted to cabinet 110 outside of upper cooking chamber 120. Thus, slide elements 172 may be positioned such that slide elements 172 are shielded from upper cooking chamber 120 and, e.g., not exposed to heated air within or from upper cooking chamber 120 when upper door 121 is in the closed position.

As may be seen in FIG. 2, cabinet 110 defines an opening 118 for accessing upper cooking chamber 120 of cabinet 110. Upper door 121 is positioned at or adjacent opening 118 of cabinet 110 when upper door 121 is in the closed position. Conversely, upper door 121 is spaced apart from cabinet 110, e.g., opening 118 of cabinet 110, along the transverse direction T when upper door 121 is in the open position. For example, upper door 121 may move along the transverse direction T on slide assemblies 172 such that upper door 121 is spaced apart from opening 118 of cabinet 110 by at least one foot along the transverse direction T when upper door 121 is in the open position.

As discussed above, upper door 121 is pivotable, e.g., on an axis that is parallel to the lateral direction L, between the vertical and peak configurations. For example, upper door 121 may be pivotable by at least thirty degrees, e.g., about an axis that is parallel to the lateral direction L, between the vertical and peak positions. As another example, upper door 121 may be pivotable by at least sixty degrees, e.g., about an axis that is parallel to the lateral direction L, between the vertical and peak positions. As yet another example, upper door 121 may be pivotable by about ninety degrees, e.g., about an axis that is parallel to the lateral direction L, between the vertical and peak positions.

When upper door 121 is in the closed position and the vertical configuration as shown in FIG. 1, upper door 121 seals or closes upper cooking chamber 120. Thus, such position and orientation of upper door 121 may be used when cooking food items within upper cooking chamber 120. If a user wants to check on the food items, the user may pivot upper door 121 to the peak position in order to allow the user to view and observe the food items within upper cooking chamber 120. Thus, when upper door 121 is in the closed position and the peak configuration as shown in FIG. 2, upper door 121 may be positioned and oriented to allow the user to view food items within upper cooking chamber 120 without removing the food items from upper cooking chamber 120. Upper door 121 is also pivotable between the vertical and peak configurations when upper door 121 is in the open position as may be seen in FIGS. 3 and 4.

Range appliance 100 also includes a rack assembly 180 that includes features for supporting food items thereon. Rack assembly 180 is slidably coupled to cabinet 110, e.g., with slide assemblies 172, such that rack assembly 180 moves with upper door 121 along the transverse direction T. Thus, food items on rack assembly 180 may be, e.g., at least partially, removed from upper cooking chamber 120 by shifting door from the closed position to the open position. In particular, with food items cooking within upper cooking chamber 120, a user of range appliance 100 may avoid having to reach into upper cooking chamber 120 in order to grasp or handle the food items located therein by grasping handle 123 of upper door 121 and shifting upper door 121 to the open position such that rack assembly 180 slides out of upper cooking chamber 120. Similarly, if the user wants to check on the food items, the user may move upper door 121 to the open position in order to remove the food items from upper cooking chamber 120 and allow the user to view and observe the food items outside of upper cooking chamber 120. Rack assembly 180 is discussed in greater detail below.

Figure 5:
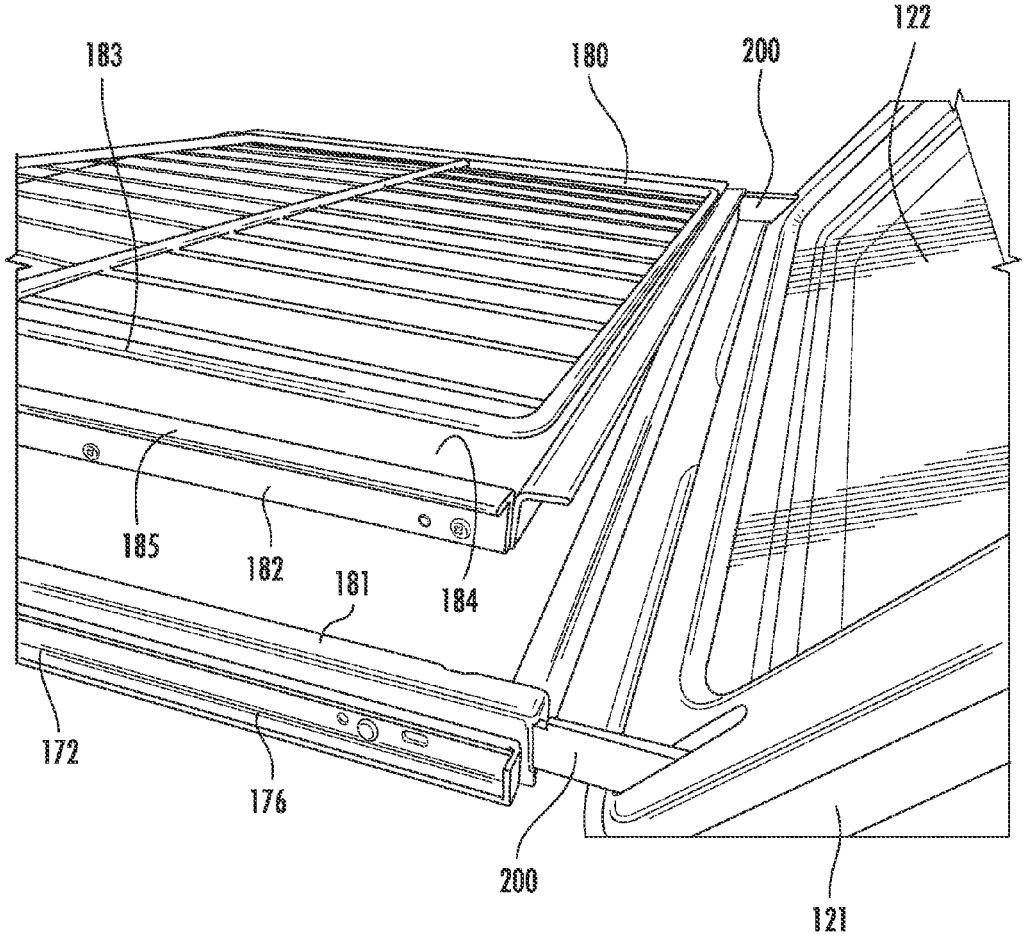
FIG. 5 provides a perspective view of a rack assembly of the exemplary oven appliance of FIG. 1 with the rack assembly partially exploded.

FIG. 5 provides a perspective view of a rack assembly 180. In FIG. 5, rack assembly 180 is shown partially exploded. As may be seen in FIG. 5, rack assembly 180 includes a frame 181, a tray 182 and a rack 183. Frame 181, tray 182 and rack 183 may each have a substantially rectangular shape or form, e.g., in a plane that is perpendicular to the vertical direction. Thus, frame 181, tray 182 and rack 183 may be nested or set together within upper cooking chamber 120.

Frame 181 is mounted to slide assemblies 172 such that frame 181 extends between slide assemblies 172, e.g., along the lateral direction L. In particular, slide rails of first and second slide assemblies 174, 176 may be mounted or fastened to frame 181. Frame 181 may rigidly couple slide assemblies 172 together in order to hinder racking or misalignment of rack assembly 180. Thus, frame 181 may couple slide assemblies 172 together such that slide assemblies 172 extend simultaneously or at a common velocity during adjustment of upper door 121 between the open and closed positions.

Tray 182 is removably mounted to frame 181, and rack 183 is disposed on tray 182. Rack 183 is configured for supporting food items thereon. Tray 182 is positioned below rack 183 and above heating element 160, e.g., along the vertical direction V. Thus, tray 182 may be positioned for catching and collecting food particles and/or liquid spills from food items on rack 183 in order to hinder or prevent such food particles and/or liquid spills from contacting heating element 160. In particular, tray 182 includes a recessed portion 184 and a lip 185 that extends about recessed portion 184 of tray 182. Recessed portion 184 of tray 182 is disposed within frame 181, and lip 185 of tray 182 is positioned on frame 181 when tray 182 is mounted to frame 181. Thus, lip 185 of tray 182 holds or supports recessed portion 184 of tray 182 within frame 181 such that recessed portion 184 of tray 182 is positioned for collecting food particles and/or liquid spills from food items on rack 183. Tray 182 may be construed of or with any suitable material. For example, tray 182 may be constructed with a metal, such as steel, with a suitable coating, such as enamel.

Figure 4:
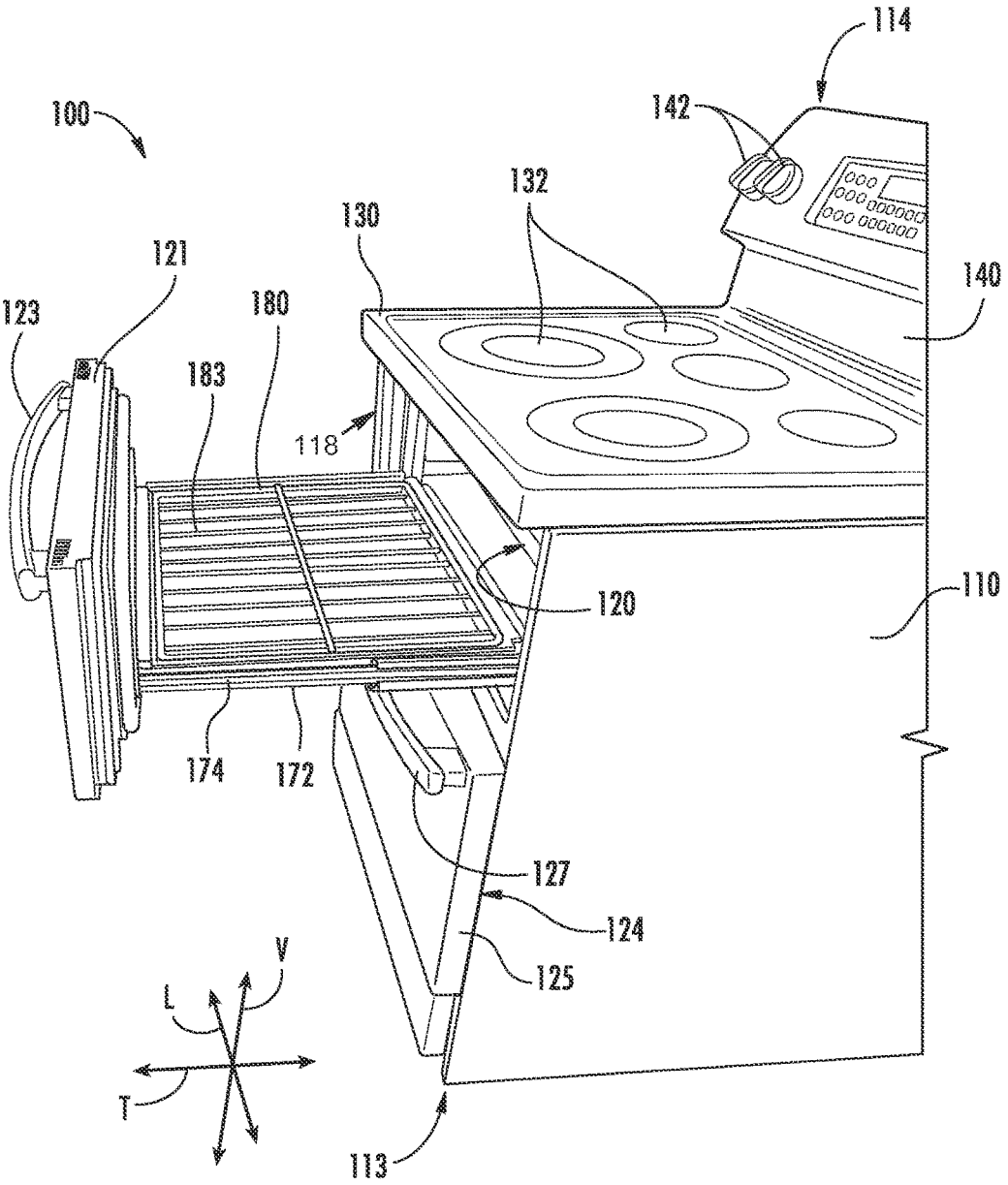

Turning back to FIGS. 1 and 2, rack 183 may be positioned within upper cooking chamber 120 when upper door 121 is in the closed position. Conversely, at least a portion of rack 183 is positioned outside of the upper cooking chamber 120 when upper door 121 is in the open position as shown in FIGS. 3 and 4. As an example, at least fifty percent of rack 183 may be disposed outside of upper cooking chamber 120 when upper door 121 is in the open position. As another example, at least ninety percent of rack 183 may be disposed outside of upper cooking chamber 120 when upper door 121 is in the open position. As yet another example, all of rack 183 may be disposed outside of upper cooking chamber 120 when upper door 121 is in the open position.

Figure 6:
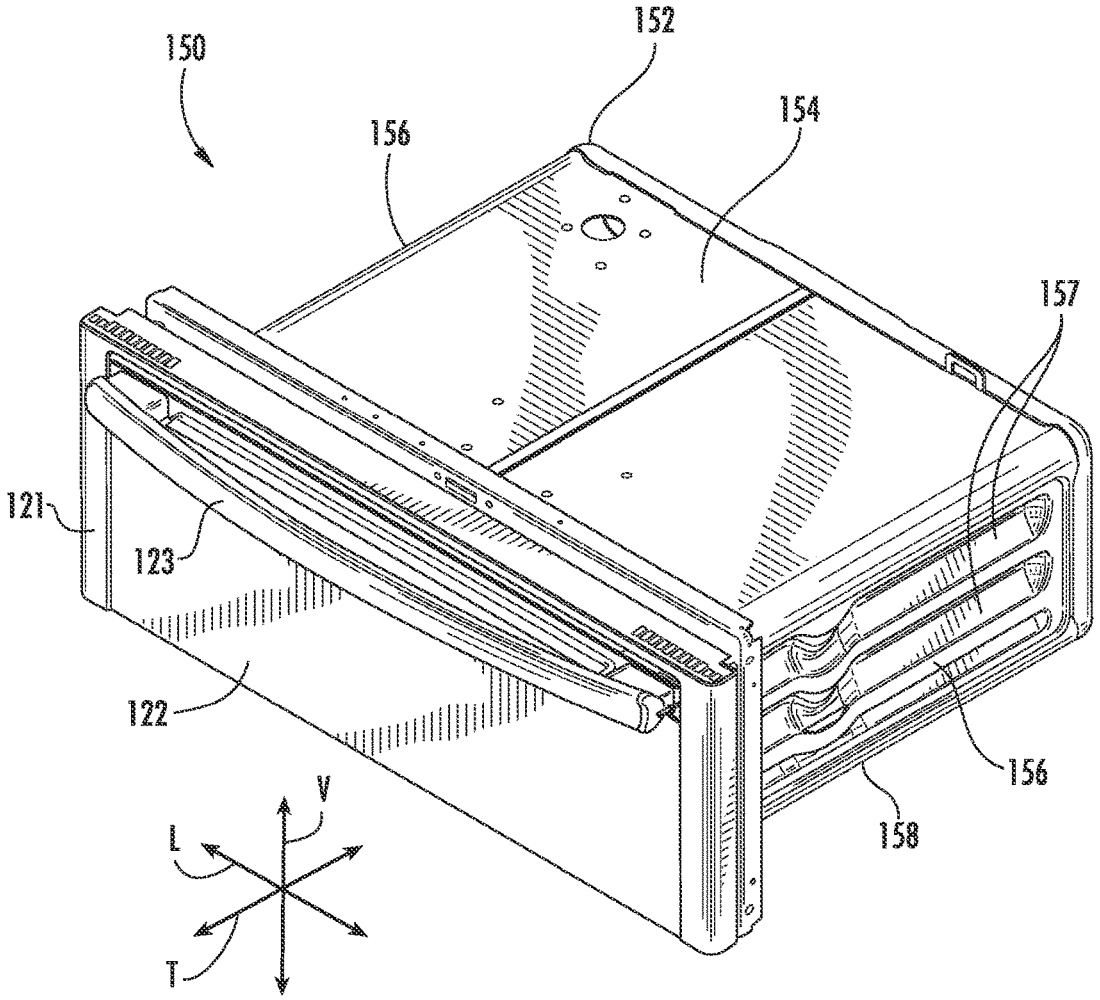
FIG. 6 provides a perspective view of a drawer assembly of the exemplary oven appliance of FIG. 1.
Figure 7:
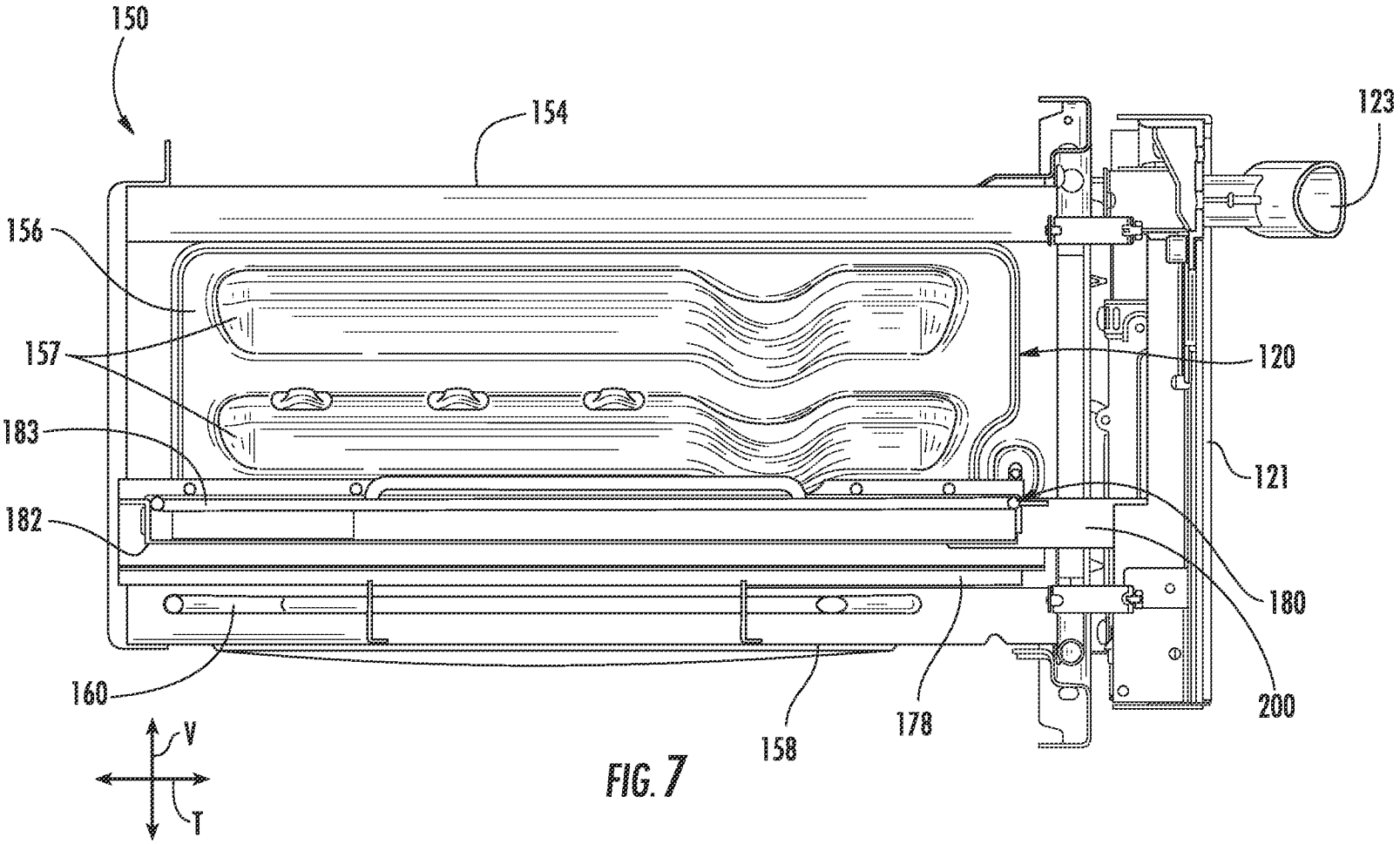
FIG. 7 provides a side section view of the drawer assembly of FIG. 6.

FIG. 6 provides a perspective view of a drawer assembly 150 of range appliance 100. FIG. 7 provides a side section view of drawer assembly 150. Drawer assembly 150 includes various components of range appliance 100 associated with upper cooking chamber 120, including upper door 121, slide assemblies 172, rack assembly 180, etc. It should be understood that lower cooking chamber 124 may be constructed in similar manner as upper cooking chamber 120 and range appliance 100 may include similar features and components for lower cooking chamber 124. Thus, lower door 125 may be mounted to slide assemblies such that lower door 125 is movable along the transverse direction T and may also be pivotable about an axis that is parallel the lateral direction L.

As may be seen in FIG. 6, drawer assembly 150 includes a chamber liner 152 that assists with defining upper cooking chamber 120. Chamber liner 152 includes a top wall 154, side walls 156 and a bottom wall 158. Top and bottom walls 154, 158 of chamber liner 152 are spaced apart from each other, e.g., along the vertical direction V. Side walls 156 of chamber liner 152 extend between and connect top and bottom walls 154, 158 of chamber liner 152, e.g., along the vertical direction V. Chamber liner 152 may be constructed of or with any suitable material. For example, chamber liner 152 may be constructed with a metal, such as steel, with a suitable coating, such as enamel. In particular, a single sheet of metal may be folded, bent or otherwise deformed to form top wall 154, side walls 156 and bottom wall 158 of chamber liner 152. As another example, top wall 154, side walls 156 and bottom wall 158 of chamber liner 152 may be formed of or with discrete metal panels.

Each side wall of side walls 156 may include or define embossed supports 157, e.g., that extend along the transverse direction T. Embossed supports 157 may be distributed along the vertical direction V, and each embossment 157 on one of side walls 156 may be aligned with a respective embossment 157 on the other one of side walls 156. A rack (not shown) may be supported on embossed supports 157. For example, the rack may be inserted between adjacent embossed supports 157 one each side wall 156.

As may be seen in FIG. 7, when upper door 121 is positioned in the closed position at cabinet 110, tray 182 is positioned over heating element 160, e.g., along the vertical direction V. In particular, tray 182 may be positioned directly over heating element 160 along the vertical direction V such that tray 182 covers heating element 160 and is disposed between heating element 160 and rack 183 along the vertical direction V when upper door 121 is in the closed position. Such positioning of tray 182 may assist with shielding heating element 160 from food particles and liquid spills. Tray 182 may also assist with uniform heating of food items within upper cooking chamber 120. For example, tray 182 may act as a radiant heat emitter during operation of heating element 160.

Figure 8:
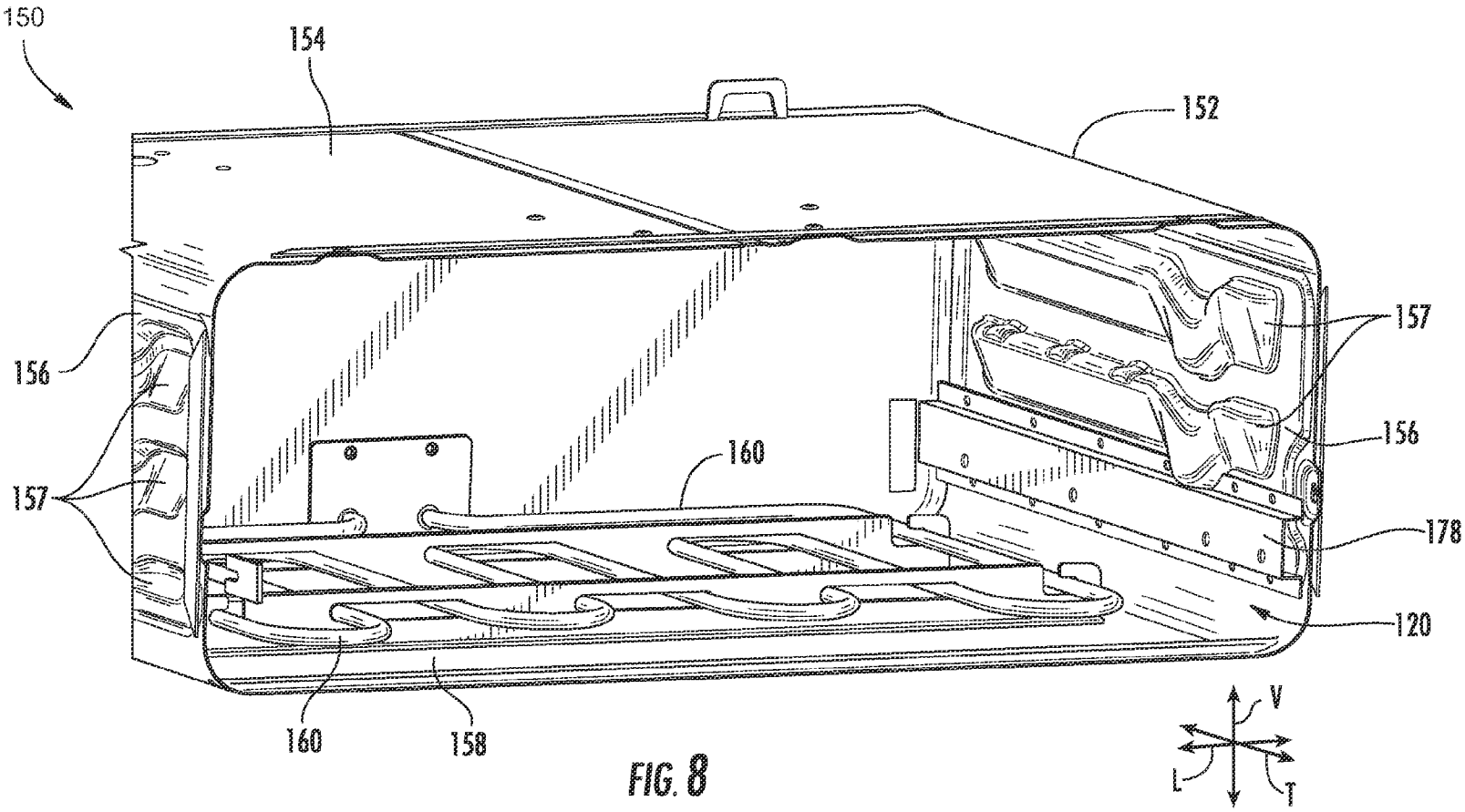
FIG. 8 provides a perspective view of certain components of the drawer assembly of FIG. 6.

FIG. 8 provides a perspective view of certain components of drawer assembly 150. As may be seen in FIG. 8, drawer assembly 150 includes at least one hat bracket 178. Hat bracket 178 is mounted to one of side walls 156 within upper cooking chamber 120. In particular, hat bracket 178 is mounted to one of side walls 156 such that hat bracket 178 is positioned over one of embossed supports 157. One of slide assemblies 172, e.g., second slide assembly 176, is mounted to hat bracket 178. In particular, a slide rail of second slide assembly 176 may be mounted or fastened to hat bracket 178. Hat bracket 178 provides a flat surface for mounting one of slide assemblies 172 in upper cooking chamber 120 over one of embossed supports 157. Thus, hat bracket 178 may extend over one of the embossed supports 157 and be mounted to one of side walls 156 of chamber liner 152.

It should be understood that in alternative exemplary embodiments, range appliance 100 need not include hat bracket 178. For example, when side walls 156 of chamber liner 152 do not include embossed supports 157, slide assemblies 172 may be directly mounted to side walls 156 of chamber liner 152 within upper cooking chamber 120. Similarly, slide assemblies 172 may be mounted to side walls 156 of chamber liner 152 with an adapter plate when side walls 156 of chamber liner 152 do not include embossed supports 157.

Figure 9:
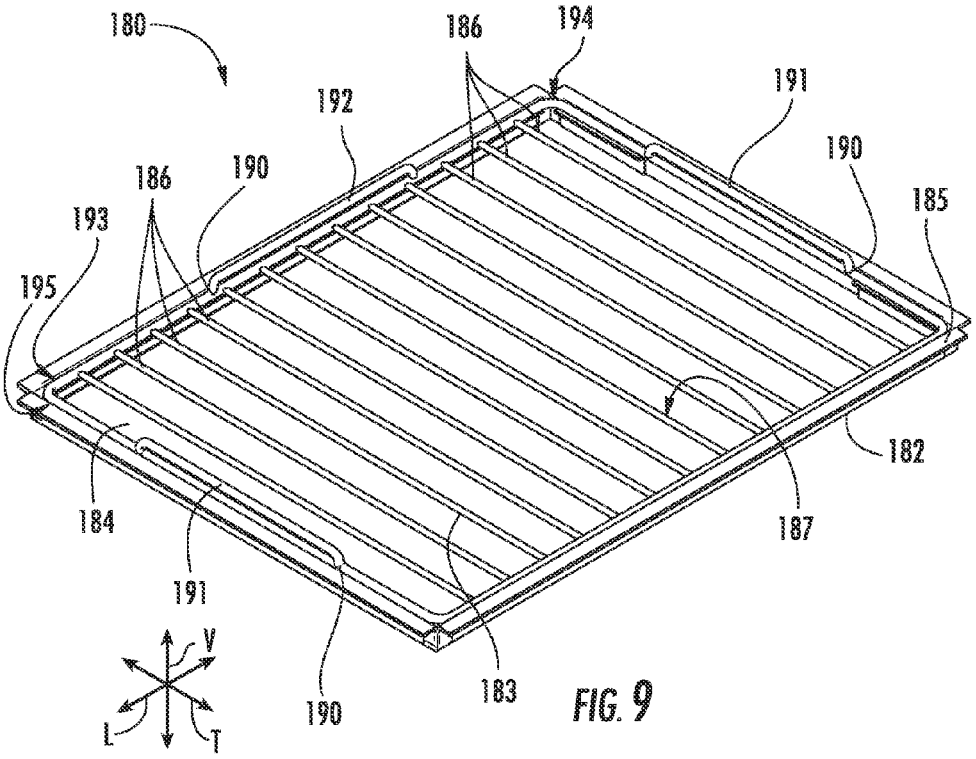
FIGS. 9, 10 and 11 provide perspective views of the rack assembly of the exemplary oven appliance of FIG. 1 with the rack assembly shown in various configurations.
Figure 10:
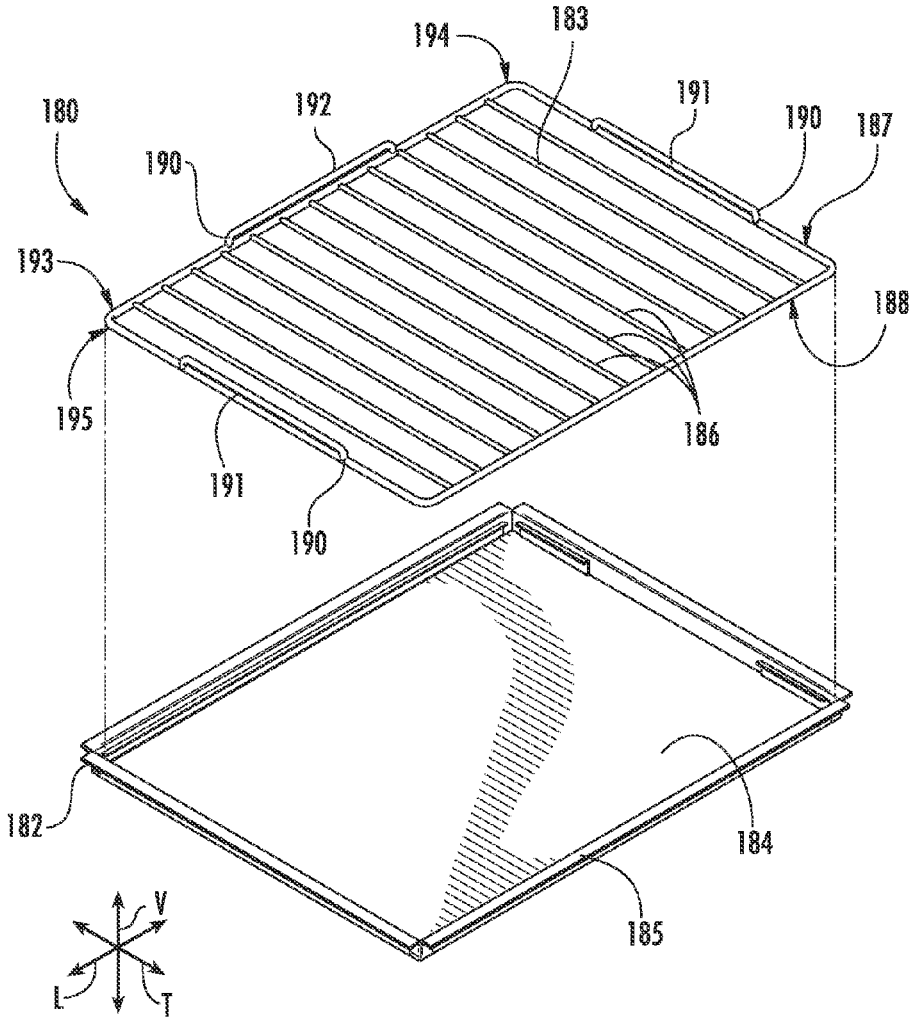
Figure 11:
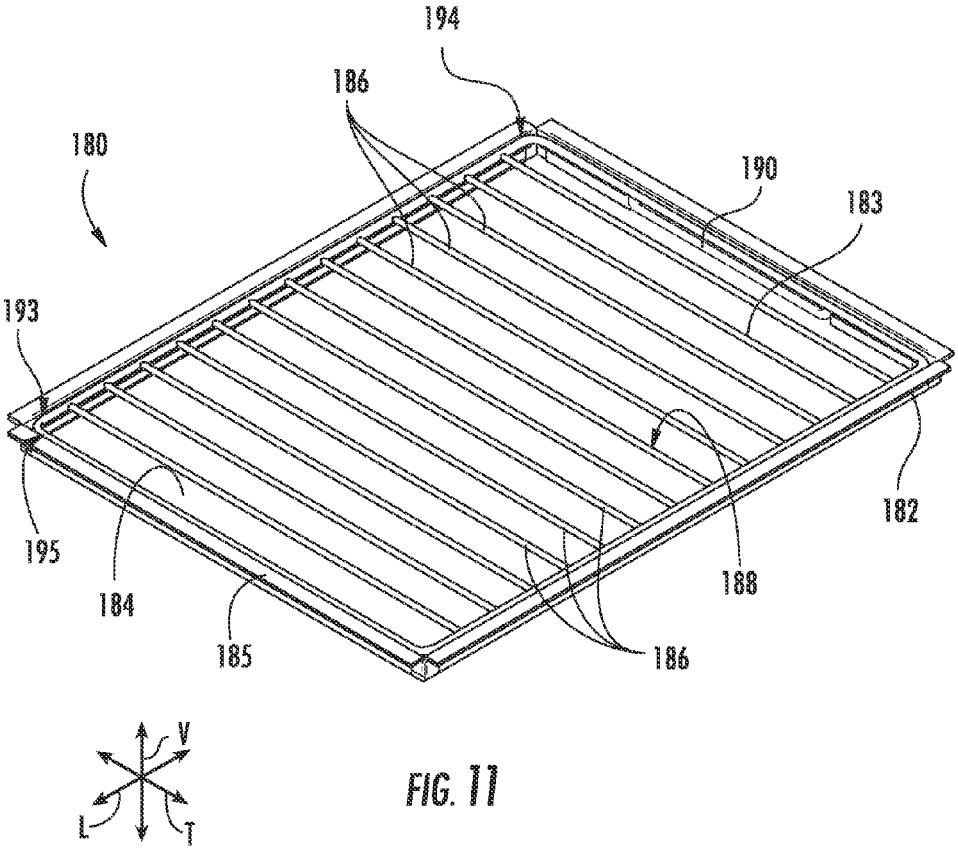

FIGS. 9, 10 and 11 provide perspective views of rack assembly 180 with rack assembly 180 shown in various configurations. As may be seen in FIG. 10, rack 183 has a first surface 187 and a second surface 188 positioned opposite each other on rack 183. Rack 183 is selectively adjustable between a first configuration and a second configuration on tray 182. Rack 183 is shown in the first configuration in FIG. 9. In the first configuration, first surface 187 of rack 183 faces upwardly along the vertical direction V. Rack 183 is shown in the second configuration in FIG. 11. In the second configuration, second surface 188 of rack 183 faces upwardly along the vertical direction V. A user of rack assembly 180 may remove rack 183 from tray 182 as shown in FIG. 10 and adjust or flip rack 183 between the first and second configurations.

First surface 187 of rack 183 may be positioned, e.g., substantially, flush with lip 185 of tray 182 when rack 183 is disposed in the first configuration. Conversely, second surface 188 of rack 183 may be positioned substantially flush with lip 185 of tray 182 when rack 183 is disposed in the second configuration. Rack assembly 180 also includes features for hindering or preventing cookware or food articles from sliding off rack 183, as discussed in greater detail below.

Rack 183 may be constructed of or with any suitable material. For example, rack 183 may be constructed with elongated metal rods or wire members 186 that are connected to one another, e.g., welded, fastened, etc., in order to form rack 183. Rack 183 also includes at least one projection 190. In the exemplary embodiment shown in FIGS. 9, 10 and 11, rack 183 includes three projections 190. However, in alternative exemplary embodiments, rack 183 may include any suitable number of projections 190. For example, rack 183 may include one projection, two projections, four projections, or more projections. Projections 190 may be separate components mounted to other elements of rack 183, or projections may be formed with or from elongated wire members 186 used to form other components of rack 183.

Projections 190 extend away from first surface 187 of rack 183. In particular, projections 190 extend upwardly along the vertical direction V from first surface 187 of rack 183 when rack 183 is in the first configuration as shown in FIG. 9. Thus, projections 190 may act as stops to prevent or hinder cookware or food articles from sliding off rack 183 when rack 183 is in the first configuration. Conversely, projections 190 extend downwardly along the vertical direction V from first surface 187 of rack 183 when rack 183 is in the second configuration. Thus, projections 190 extend into recessed portion 184 of tray 182 when rack 183 is in the second configuration as shown in FIG. 11. Thus, if not desired, projections 190 may be stored within recessed portion 184 of tray 182 and not interfere with sliding of cookware or food articles on rack 183 when rack 183 is in the second configuration.

Projections 190 may be positioned at any suitable location on rack 183, e.g., at or adjacent any suitable edge of rack 183. In the exemplary embodiment shown in FIGS. 9, 10 and 11, projections 190 include side projections 191 and a back projection 192. Side projections 191 are each disposed at and extend along at a respective one of a first side portion 193 of rack 183 and a second side portion 194 of rack 183. Thus, side projections 191 may be spaced apart from each other along the lateral direction L and positioned at opposite lateral sides of rack 183. Back projection 192 is positioned at and extends along a back portion 195 of rack 183. Rack 183 may also include a front projection (not shown) that extends away from first surface 187 of rack 183 at or adjacent a front portion of rack 183 such that the front projection is positioned opposite back projection 192 on rack 183.

Side projections 191 may assist with hindering or preventing cookware or food articles from sliding off first and second side portions 193, 194 of rack 183, and back projection 192 may assist with hindering or preventing cookware or food articles from sliding off back portion 195 of rack 183 when rack 183 is in the first configuration. It should be understood that, in alternative exemplary embodiments, rack 183 may also include projections 190 that extend away from second surface 188 of rack 183 in any suitable combination with projections 190 that extend away from first surface 187 of rack 183.

Figure 12:
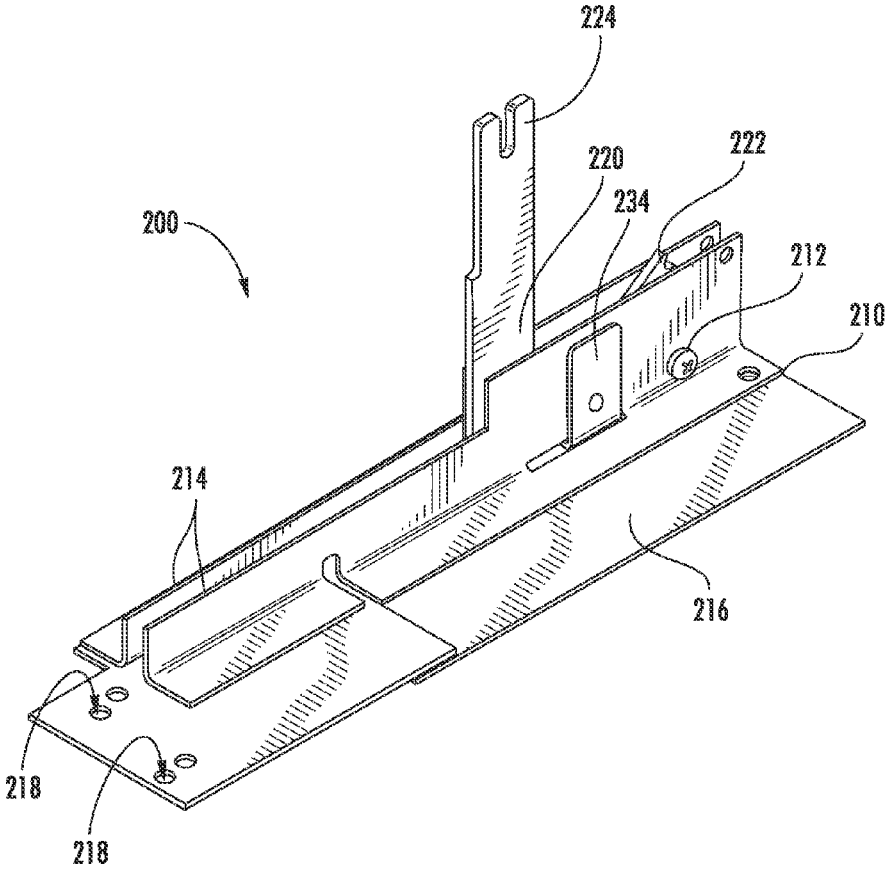
FIG. 12 provides a perspective view of a hinge assembly of the exemplary oven appliance of FIG. 1.
Figure 13:
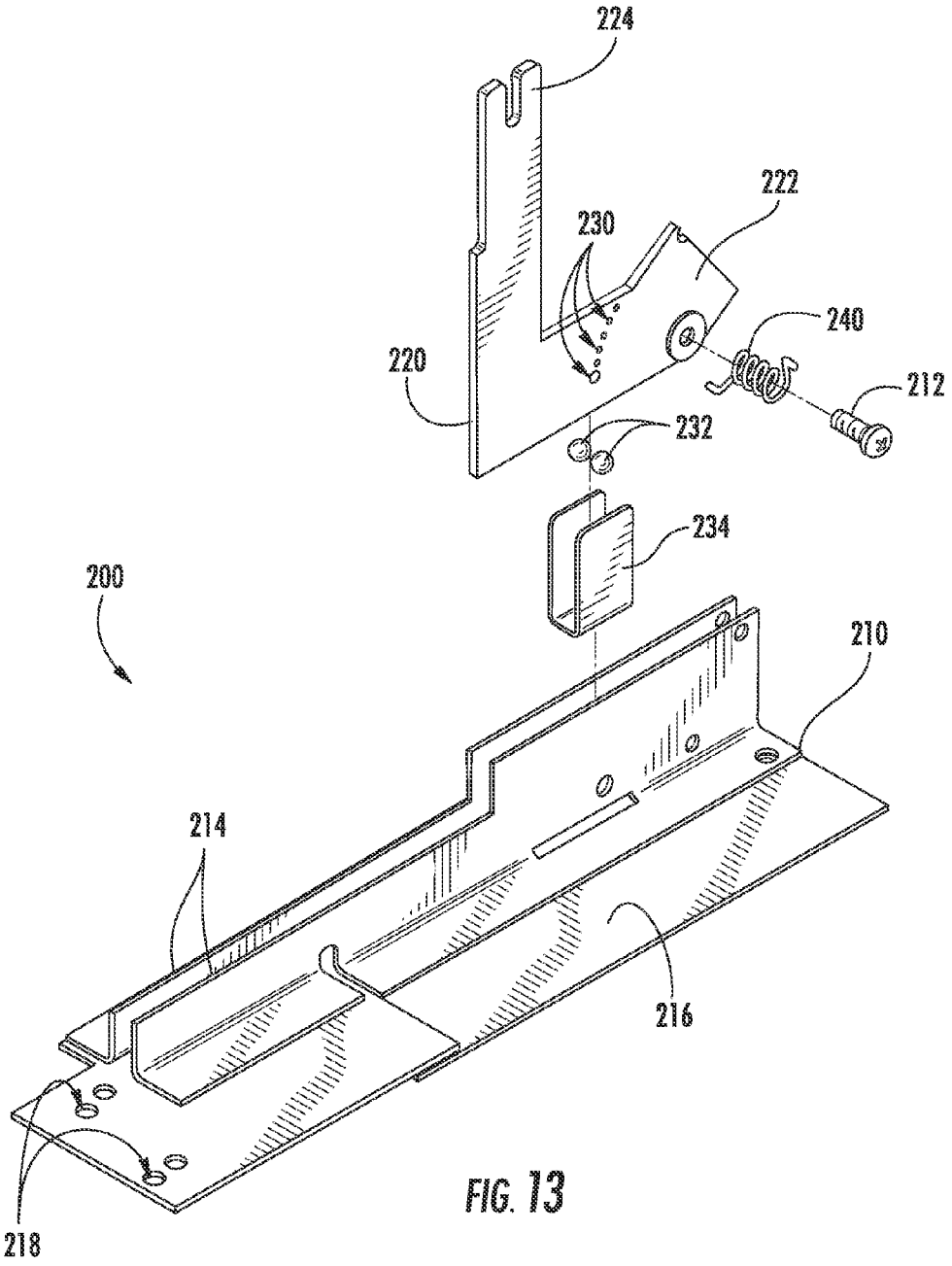
FIG. 13 provides an exploded view of the hinge assembly of FIG. 12.

FIG. 12 provides a perspective view of a hinge assembly 200 of range appliance 100. FIG. 13 provides an exploded view of hinge assembly 200. Hinge assembly 200 pivotally couples upper door 121 to cabinet 110 and/or at least one of slide assemblies 172 such that upper door 121 is pivotable between the vertical and peak positions. As may be seen in FIGS. 12 and 13, hinge assembly 200 includes a bracket 210, a hinge arm 220 and a bearing 232.

Bracket 210 is mounted to upper door 121. In particular, bracket 210 includes support plates 214 and a base plate 216. Base plate 216 defines mounting holes 218, and fasteners (not shown) may extend through mounting holes 218 of base plate 216 into upper door 121 in order to mount bracket 210 to upper door 121. Support plates 214 are mounted or fixed to base plate 216 and extend away from base plate 216.

Hinge arm 220 is rotatably mounted to bracket 210. In particular, hinge arm 220 may be positioned between support plates 214 of bracket 210. A pivot pin 212 extends through support plates 214 and hinge arm 220 in order to rotatably mount hinge arm 220 to bracket 210. Hinge arm 220 includes a first arm 222 and a second arm 224, e.g., that are perpendicularly oriented to each other. Pivot pin 212 may extend through first arm 222, e.g., at or adjacent a distal end portion of first arm 222. Second arm 224 of hinge arm 220 may be mounted to any suitable component of drawer assembly 150. For example, second arm 224 may be mounted to frame 181, e.g., at or adjacent a distal end portion of second arm 224. As another example, second arm 224 may be directly mounted to one of slide assemblies 172.

As may be seen in FIG. 13, hinge arm 220 also defines a series of detents 230, e.g., on first arm 222 of hinge arm 220. As may be seen in FIG. 13, detents 230 may be distributed in an arcuate shape or path. Bearing 232 is disposed within one of detents 230 such that bearing 232 extends between bracket 210 and hinge arm 220. Bearing 232 engages hinge arm 220 at the one of the detents 230 such that bearing 232 hinders pivoting of hinge arm 220 relative to bracket 210 and thereby hinders or prevents pivoting of upper door 121.

Hinge assembly 200 also includes a biasing mechanism 234. Biasing mechanism 234 is positioned and oriented for urging bearing 232 into the one of the detents 230. Biasing mechanism 234 may be any suitable mechanism for urging bearing 232 into the one of the detents 230. For example, biasing mechanism 234 may be a spring plate as shown in FIGS. 12 and 13. In alternative exemplary embodiments, biasing mechanism 234 may be a torsion spring, a compression spring or an extension spring. By urging bearing 232 into the one of the detents 230, biasing mechanism 234 may hold upper door 121 in position and hinder unwanted pivoting of upper door 121. To pivot upper door 121, a user of range appliance 100 may urge upper door 121 to pivot such that bearing 232 shifts between adjacent detents of detents 230. Thus, the user may pivot upper door 121 between the vertical and peak configurations by grasping upper door 121 and overcoming the force applied by bearing 232 by biasing mechanism 234 such that bearing 232 shifts between adjacent detents of detents 230. When bearing 232 shifts between adjacent detents of detents 230, a user may feel such shifting and such shifting may have "stereo knob" feel that provides feedback to the user regarding the pivoting of upper door 121. Bearing 232 may be any suitable type of bearing. For example, bearing 232 may be a ball bearing, a cylindrical bearing, etc.

As may be seen in FIG. 13, hinge assembly 200 also includes a biasing device 240. Biasing device 240 is coupled to upper door 121 and is configured for urging upper door 121 towards the vertical configuration. Thus, biasing device 240 may resist pivoting of upper door 121 to the peak configuration in order to avoid undesired opening of upper door 121. Biasing device 240 may be any suitable type of biasing device. As an example, biasing device 240 may be a coil spring that extends between bracket 210 and hinge arm 220 and, e.g., is charged or loaded when upper door 121 is not in the vertical configuration. As another example, biasing device 240 may be a torsion bar or a gas spring coupled to upper door 121.

Turning back to FIG. 5, slide assemblies 172, frame 181 of rack assembly 180, and hinge assembly 200 are coupled to each other such that force is transferred between such components in a planar or linear manner. For example, slide assemblies 172, frame 181 of rack assembly 180, and hinge assembly 200, e.g., second arm 224 of hinge assembly 200, may be positioned coplanar with each other, e.g., in a plane that is perpendicular to the vertical direction V. Thus, when a user pulls on upper door 121, force applied by the user is transferred within the plane between such components. In such a manner, upper drawer 121 may slide or adjust more easily between the open and closed positions.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance defining a lateral direction and a transverse direction, the lateral and transverse directions being perpendicular to each other, the oven appliance comprising:

a cabinet defining a cooking chamber and an opening for accessing the cooking chamber of the cabinet, the cabinet extending between a first side portion and a second side portion along the lateral direction;

a heating element positioned at the cooking chamber of the cabinet;

a first slide assembly mounted to the cabinet at the first side portion of the cabinet;

a second slide assembly mounted to the cabinet at the second side portion of the cabinet;

a door positioned adjacent the opening of the cabinet, the first and second slide assemblies coupling the door to the cabinet such that the door is movable along the transverse direction relative to the cabinet; and a hinge assembly coupling the door to at least one of the first and second slide assemblies such that the door is pivotable between a vertical position and a peak position, the hinge assembly comprising a bracket mounted to the door;

a hinge arm rotatably mounted to the bracket, the hinge arm defining a series of detents; and a bearing disposed within one of the series of detents and extending between the bracket and the hinge arm, wherein the bearing engages hinge arm at the one of the series of detents such that the bearing hinders pivoting of the hinge arm and the door.

2. The oven appliance of claim 1, further comprising a frame and a rack, the frame mounted to the first and second slide assemblies such that the frame extends between the first and second slide assemblies along the transverse direction, the rack positioned on the frame.

3. The oven appliance of claim 2, wherein the hinge arm of the hinge assembly is mounted to the frame.

4. The oven appliance of claim 1, wherein the hinge arm of the hinge assembly is mounted to one of the first and second slide assemblies.

5. The oven appliance of claim 1, wherein the series of detents is distributed in an arcuate shape.

6. The oven appliance of claim 1, wherein the door is pivotable by at least thirty degrees in a plane that is perpendicular to the transverse direction between the vertical position and the peak position.

7. The oven appliance of claim 1, wherein the hinge assembly further comprises a biasing mechanism, the biasing mechanism urging the bearing into the one of the series of detents.

8. The oven appliance of claim 1, further comprising a biasing device coupled to the door, the biasing device configured for urging the door towards the vertical position.

9. The oven appliance of claim 1, wherein the bearing shifts between adjacent detents of the series of detents during pivoting of the door.

10. A double oven range appliance defining a vertical direction, a lateral direction and a transverse direction, the vertical, lateral and transverse directions being mutually perpendicular, the double oven range appliance comprising:

a cabinet extending between a first side portion and a second side portion along the lateral direction, the cabinet also extending between a top portion and a bottom portion along the vertical direction, the cabinet defining an upper cooking chamber positioned adjacent the top portion of the cabinet and a lower cooking chamber positioned adjacent the lower portion of the cabinet, the cabinet also defining an opening for accessing the upper cooking chamber of the cabinet;

a heating element positioned at the upper cooking chamber of the cabinet;

a pair of slide assemblies mounted to the cabinet at the upper cooking chamber, each slide assembly of the pair of slide assemblies positioned at a respective one of the first and second side portions of the cabinet;

a door positioned adjacent the opening of the cabinet, the pair of slide assemblies coupling the door to the cabinet such that the door is movable along the transverse direction relative to the cabinet; and a hinge assembly coupling the door to one of the pair of slide assemblies such that the door is pivotable between a vertical position and a peak position, the hinge assembly comprising a bracket mounted to the door;

a hinge arm rotatably mounted to the bracket, the hinge arm defining a series of detents; and a bearing disposed within one of the series of detents and extending between the bracket and the hinge arm, wherein the bearing engages hinge arm at the one of the series of detents such that the bearing hinders pivoting of the hinge arm and the door.

11. The double oven range appliance of claim 10, further comprising a frame and a rack, the frame mounted to the slide assemblies of the pair of slide assemblies such that the frame extends between the slide assemblies of the pair of slide assemblies along the transverse direction, the rack positioned on the frame.

12. The double oven range appliance of claim 11, wherein the hinge arm of the hinge assembly is mounted to the frame.

13. The double oven range appliance of claim 10, wherein the hinge arm of the hinge assembly is mounted to one of the pair of slide assemblies.

14. The double oven range appliance of claim 10, wherein the series of detents is distributed in an arcuate shape.

15. The double oven range appliance of claim 10, wherein the door is pivotable by at least thirty degrees in a plane that is perpendicular to the transverse direction between the vertical position and the peak position.

16. The double oven range appliance of claim 10, wherein the hinge assembly further comprises a biasing mechanism, the biasing mechanism urging the bearing into the one of the series of detents.

17. The double oven range appliance of claim 10, further comprising a biasing device coupled to the door, the biasing device configured for urging the door towards the vertical position.

18. The double oven range appliance of claim 10, wherein the bearing shifts between adjacent detents of the series of detents during pivoting of the door.

19. An oven appliance defining a lateral direction and a transverse direction, the lateral and transverse directions being perpendicular to each other, the oven appliance comprising:

a cabinet defining a cooking chamber and an opening for accessing the cooking chamber of the cabinet, the cabinet extending between a first side portion and a second side portion along the lateral direction;

a heating element positioned at the cooking chamber of the cabinet;

a first slide assembly mounted to the cabinet at the first side portion of the cabinet;

a second slide assembly mounted to the cabinet at the second side portion of the cabinet;

a door positioned adjacent the opening of the cabinet, the first and second slide assemblies coupling the door to the cabinet such that the door is movable along the transverse direction relative to the cabinet; and a hinge assembly coupling the door to at least one of the first and second slide assemblies such that the door is pivotable between a vertical position and a peak position, the hinge assembly comprising a bracket mounted to the door;

a hinge arm rotatably mounted to the bracket, the hinge arm defining a series of detents;

a bearing disposed within one of the series of detents and extending between the bracket and the hinge arm; and a biasing mechanism urging the bearing into the one of the series of detents.

20. The double oven range appliance of claim 19, further comprising a biasing device coupled to the door, the biasing device configured for urging the door towards the vertical position.

* * * * *